US008745807B2

(12) United States Patent
Varner et al.

(10) Patent No.: US 8,745,807 B2
(45) Date of Patent: Jun. 10, 2014

(54) SCRUBBING APPARATUS AND METHOD

(76) Inventors: Donald Varner, Carmel, CA (US); Thomas L. Palecki, Cornville, AZ (US)

( * ) Notice: Subject to any disclaimer, the term of this patent is extended or adjusted under 35 U.S.C. 154(b) by 0 days.

(21) Appl. No.: 12/212,621

(22) Filed: Sep. 17, 2008

(65) Prior Publication Data

US 2010/0064459 A1 Mar. 18, 2010

(51) Int. Cl.

| | |
|---|---|
| ***A46B 1/00*** | (2006.01) |
| ***A46B 5/02*** | (2006.01) |
| ***A47K 7/02*** | (2006.01) |

(52) U.S. Cl.

USPC ..... 15/187; 15/105; 15/110; 15/188

(58) Field of Classification Search

USPC ..... 15/105, 186, 187, 188, 110, 236.06; D4/127, 136; D28/7; D30/158; D32/42; 119/625, 633

See application file for complete search history.

(56) References Cited

U.S. PATENT DOCUMENTS

| | | | | | |
|---|---|---|---|---|---|
| 1,006,630 | A | * | 10/1911 | Clarke | 15/188 |
| 1,833,555 | A | * | 11/1931 | Bell et al. | 15/188 |
| 1,892,068 | A | * | 12/1932 | Metzler | 601/139 |
| 1,903,161 | A | * | 3/1933 | Barkan | 15/188 |
| 2,103,083 | A | * | 12/1937 | Lynch | 601/139 |
| 2,686,325 | A | * | 8/1954 | Silver | 15/188 |
| 2,764,773 | A | * | 10/1956 | Wise et al. | 15/188 |
| 3,151,346 | A | * | 10/1964 | Gray | 15/187 |
| 3,176,338 | A | * | 4/1965 | Homburger | 401/7 |
| 4,249,521 | A | * | 2/1981 | Gueret | 601/137 |
| 4,343,265 | A | * | 8/1982 | Belschner | 119/633 |
| D315,038 | S | * | 2/1991 | Strickler | D30/158 |
| 5,060,337 | A | * | 10/1991 | Van Niekerk | 15/111 |
| D326,562 | S | * | 6/1992 | Bertwell | D4/136 |
| 5,429,678 | A | * | 7/1995 | Fany | 134/6 |
| 6,266,839 | B1 | * | 7/2001 | Oretti et al. | 15/117 |
| 6,374,449 | B1 | * | 4/2002 | Jolly | 15/161 |
| D514,328 | S | * | 2/2006 | Huang | D4/121 |
| D532,979 | S | * | 12/2006 | Viola | D4/129 |
| 7,607,189 | B2 | * | 10/2009 | Moskovich | 15/111 |
| 2003/0163884 | A1 | * | 9/2003 | Weihrauch | 15/207.2 |
| 2004/0134007 | A1 | * | 7/2004 | Davies | 15/110 |

* cited by examiner

*Primary Examiner* — Randall Chin

(74) *Attorney, Agent, or Firm* — Donald R. Boys; Central Coast Patent Agency, Inc.

(57) ABSTRACT

An apparatus and method that efficiently scrubs and massages a surface without the need for a washcloth and effectively inhibits growth of mold and bacteria. The apparatus is designed to fit within a human hand to facilitate ease in use. The material that the apparatus is made from can be quick drying and antibacterial. The apparatus can be used on both humans and animals for grooming.

4 Claims, 9 Drawing Sheets

Fig. 8
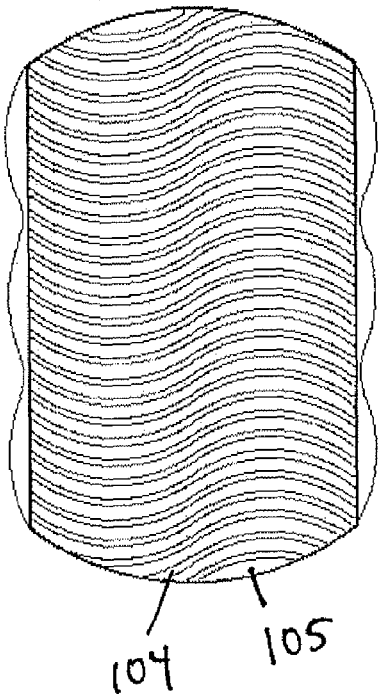
Fig. 6
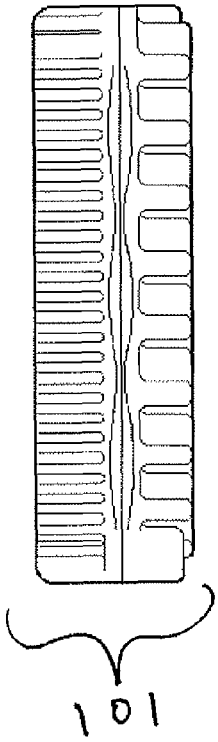
Fig. 5
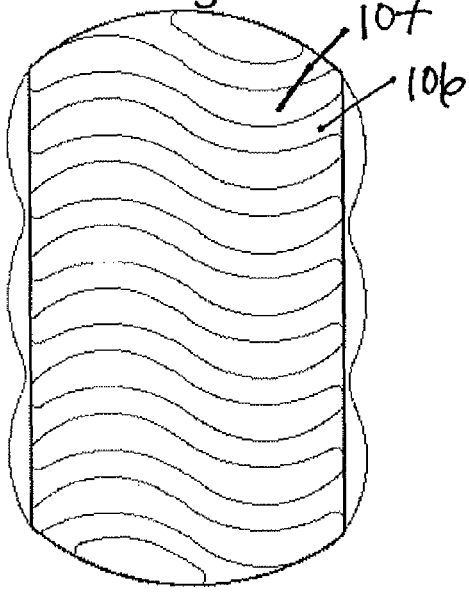
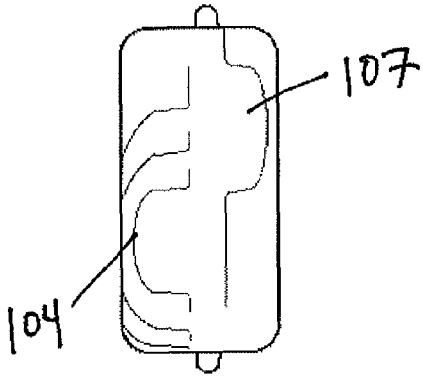
Fig. 7

SCRUBBING APPARATUS AND METHOD

TECHNICAL FIELD

This invention is directed to an apparatus and method for scrubbing and massaging a variety of surfaces. The apparatus and methods for scrubbing and massaging in the present invention encompasses multiple applications for using the present invention. In particular, the present invention relates to an apparatus and method for scrubbing and massaging surfaces such as a human body or animal. A form can be molded on each side of the apparatus specific for massage or scrubbing. The form molded for scrubbing and massaging can be on one side or both sides of the apparatus. Various handles can be molded on the apparatus for easy handling and manipulation of the apparatus.

BACKGROUND ART

Consumers of products related to the bath and body industry have special needs with regards to the products they can use within the bath and shower. The products must be durable enough to withstand use in water of varying temperatures, application of different body cleansing products, as well as, an ability to resist bacterial growth. Currently there is an unmet need for a product which can fit in the palm of one's hand, that provides both scrubbing power and therapeutic massage, and that can be used at high water temperatures without breaking down from heat, cleansers and bacterial growth. The present invention solves these multiple issues by providing a scrubber and massager in various sizes, for example the size of a bar of soap, out of a material that is safe to use in water and with cleansers, and that dries quickly to resist common growth of mold and bacteria that occurs in warm humid environments such as a shower or bath. The apparatus can be used for personal grooming and pet grooming.

DISCLOSURE OF INVENTION

The present invention addresses the need for an apparatus that can be easily used in a shower or bath to both scrub and massage a body, effectively eliminating the need for a washcloth. The invention further provides a shape which like a bar of soap, fits into the palm of one's hand, for easier manipulation of the body bar on surfaces. Each side of the body bar has a molded form specific to either scrubbing or massaging a surface. In another aspect the invention has a handle on one side to make it easy to scrub or massage a surface. The apparatus can be applied to various body parts for a human and a animal. Further, the material that the apparatus is made from is quick drying to inhibit growth of mold and bacteria on the apparatus.

BRIEF DESCRIPTION OF DRAWINGS

For fuller understanding of the present invention, reference is made to the accompanying drawings numbered below. Commonly used reference numbers identify the same or equivalent parts of the claimed invention throughout the several figures.

FIG. 5 is a top view of the apparatus in a body bar form, showing the body massaging side, according to an embodiment of the present invention.

FIG. 6 is a side view of the apparatus of FIG. 5.

FIG. 7 is an end view of the apparatus of FIG. 5.

FIG. 8 is a bottom view of the body bar of FIG. 5, showing the body scrubbing side.

BEST MODES FOR CARRYING OUT THE INVENTION

Apparatus 101 has a different molded form for the top and bottom side in order to facilitate different functions such as scrubbing or massaging of a body and various handles. The size of the apparatus 101 can be of various sizes and shapes. For example it can be similar to the size of a bar of soap or smaller to accommodate grooming a cat. These various sizes provide a comfortable size for a user's hand to hold the apparatus 101 while implementing the multiple methods of scrubbing and massaging. The apparatus can also have a handle so that the user can securely hold the apparatus while massaging or scrubbing.

Figure 1:
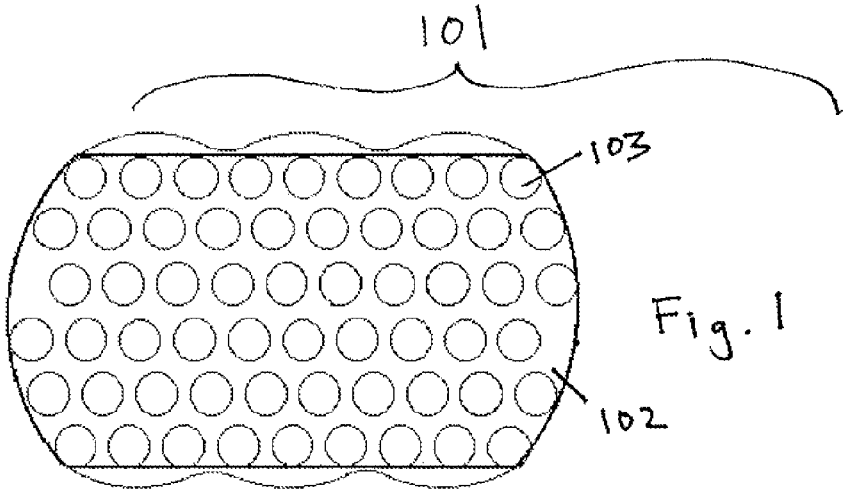
FIG. 1 is a top view of the apparatus in a body bar form, showing the head/hair scrubbing side, according to an embodiment of the present invention.

FIG. 1 is a top view of an apparatus 101 in body bar form, showing the head/hair scrubbing surface 102, according to an embodiment of the present invention. The surface 102 has multiple head/hair protuberances 103 for scrubbing. The protuberances 103 can be of multiple heights and widths, as well as spaced at varying distances from one another, and in different spatial arrangements, in order to facilitate a range of scrubbing intensities.

Figure 4:
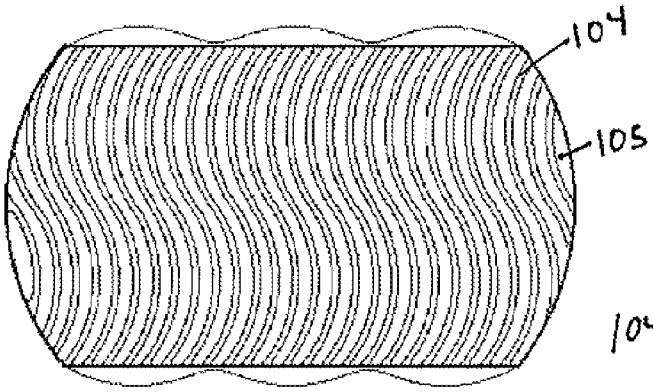
FIG. 4 is a bottom view of the body bar of FIG. 1, showing the body scrubbing side.

FIG. 4 is a bottom view of the apparatus 101 of FIG. 1, showing the body scrubbing surface 105. The surface 105 has body scrubber ribs 104 closely stacked together. This helps to hold the liquid soap during the scrubbing of the body and to create a rich lather. The ribs 104 can be of multiple heights and widths, as well as spaced at varying distances from one another, and in different spatial arrangements, in order to facilitate a range of scrubbing intensities.

Figure 2:
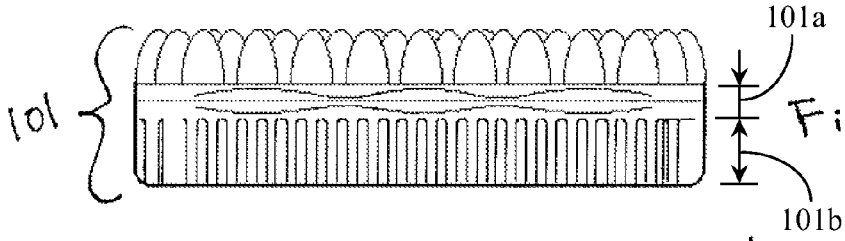
FIG. 2 is a side view of the apparatus of FIG. 1.
Figure 3:
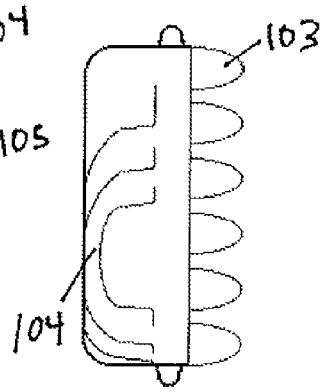
FIG. 3 is an end view of the apparatus of FIG. 1.

FIG. 2 is a side view of the apparatus 101 of FIG. 1. It shows the protuberances 103 of the head/hair scrubbing surface 102 and the ribs 104 of the body scrubber surface 105. A central panel resides between the surface 102 and surface 105 having a height 101*a*. Height 101*b* of the ribs 104, as shown, is at least equal to or greater than the height of the central panel 101*a*. The overall height and width of the body bar 101 is similar to the size of a standard bar of soap. FIG. 3 is an end view of the apparatus 101 of FIG. 1, further emphasizing a user friendly size that fits in the palm of a user's hand.

FIG. 5 is a top view of the apparatus 101, showing the body massaging surface 106, according to an embodiment of the present invention. The surface 106 has multiple ribs 107 for massaging. The ribs 107 can be of multiple heights and widths, as well as spaced at varying distances from one another, and in different spatial arrangements, in order to facilitate a range of massaging intensities. The body massaging surface 106 may reduce the look of cellulite when a user applies pressure to massage cellulite with the ribs 107. The massaging surface 106 can also be used outside of the bath by athletes to prevent muscle cramping by massaging the body after exercise.

FIG. 8 is a bottom view of the apparatus 101 of FIG. 5, showing the body scrubbing surface 105. The surface 105 has body scrubber ribs 104 closely stacked together. This helps to hold the liquid soap during the scrubbing of the body and to create a rich lather. The ribs 104 can be of multiple heights and widths, as well as spaced at varying distances from one another, and in different spatial arrangements, in order to facilitate a range of scrubbing intensities.

FIG. 6 is a side view of the apparatus 101 of FIG. 5. It shows the massaging ribs 107 of the body massaging surface 106 and the body scrubber ribs 104 of the body scrubber surface 105. The overall height and width of the apparatus 101 is similar to the size of a standard bar of soap. FIG. 7 is an end view of the apparatus 101 of FIG. 5, further emphasizing a user friendly size that fits in the palm of a user's hand.

Figure 9:
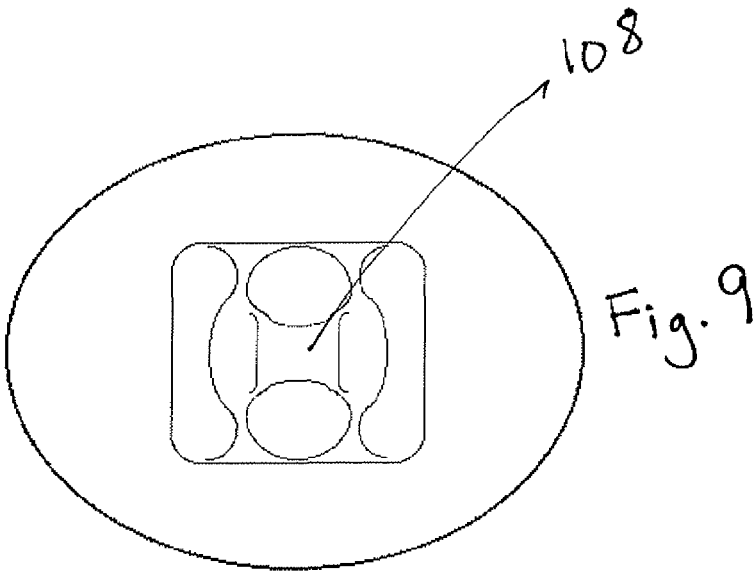
FIG. 9 is a top view of the apparatus in a oval form, showing the finger ring handle, according to an embodiment of the present invention.
Figure 10:
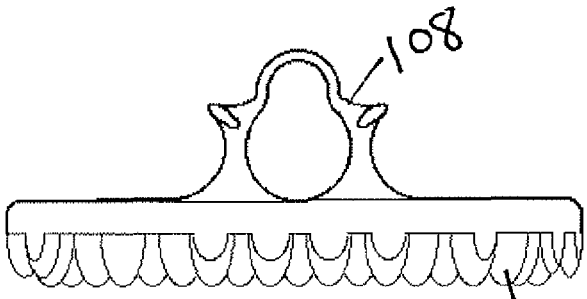
FIG. 10 is a side view of the apparatus of FIG. 9.
Figure 11:
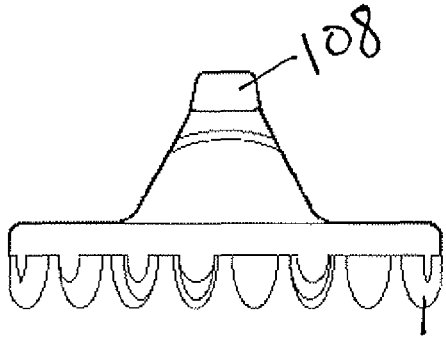
FIG. 11 is an end view of the apparatus of FIG. 9.
Figure 12:
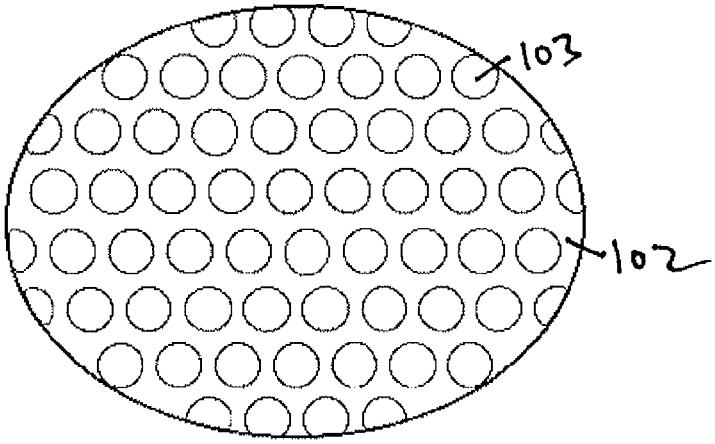
FIG. 12 is a bottom view of the apparatus in oval form of FIG. 9, showing the head/hair scrubbing side.

FIG. 9 is a top view of the apparatus 101 in a oval form, showing the finger ring handle, according to an embodiment of the present invention. FIG. 10 is a side view of the apparatus of FIG. 9. showing the finger ring handle 108 and protuberances 103. FIG. 11 is an end view of the apparatus of FIG. 9. FIG. 12 is a bottom view of the apparatus in oval form of FIG. 9, showing the head/hair scrubbing side. The surface 102 has multiple head/hair protuberances 103 for scrubbing. The protuberances 103 can be of multiple heights and widths, as well as spaced at varying distances from one another, and in different spatial arrangements, in order to facilitate a range of scrubbing intensities.

Figure 13:
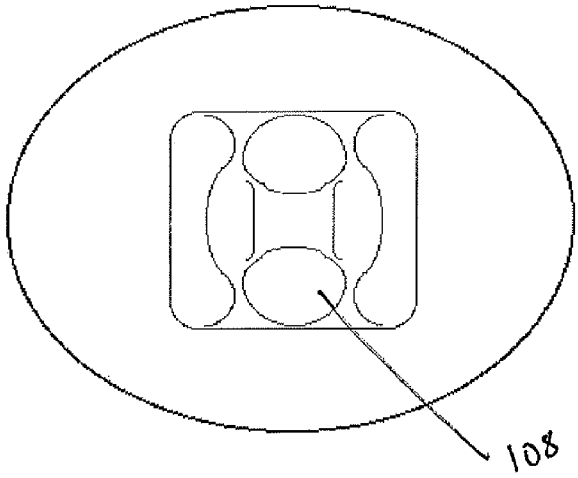
FIG. 13 is a top view of the apparatus in a oval form, showing the finger ring handle, according to an embodiment of the present invention.
Figure 14:
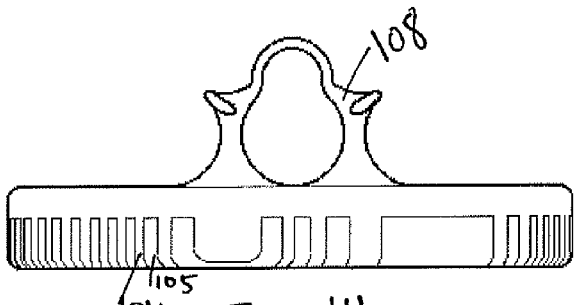
FIG. 14 is a side view of the apparatus of FIG. 13.
Figure 15:
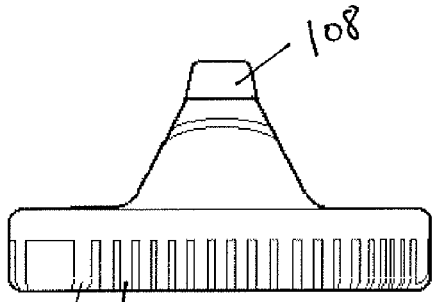
FIG. 15 is an end view of the apparatus of FIG. 13.
Figure 16:
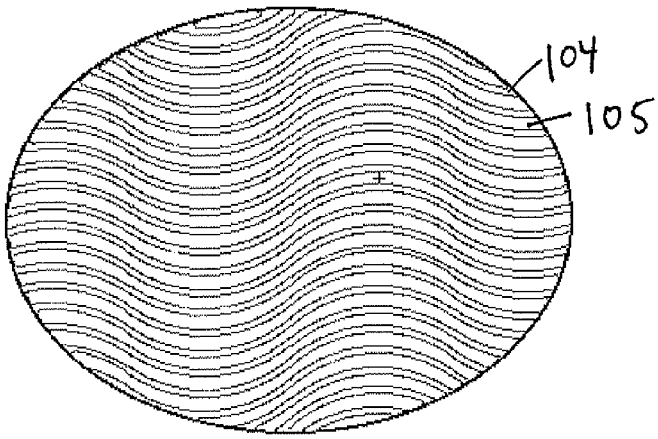
FIG. 16 is a bottom view of the apparatus in oval form of FIG. 13, showing the body scrubbing side.

FIG. 13 is a top view of the apparatus in a oval form, showing the finger ring handle 108, according to an embodiment of the present invention. FIG. 14 is a side view of the apparatus of FIG. 13. Showing the finger ring handle 108. FIG. 15 is an end view of the apparatus of FIG. 13. FIG. 16 is a bottom view of the apparatus 101 in oval form of FIG. 13, showing the body scrubbing surface 105. The surface 105 has body scrubber ribs 104 closely stacked together. This helps to hold the liquid soap during the scrubbing of the body and to create a rich lather. The ribs 104 can be of multiple heights and widths, as well as spaced at varying distances from one another, and in different spatial arrangements, in order to facilitate a range of scrubbing intensities.

Figure 17:
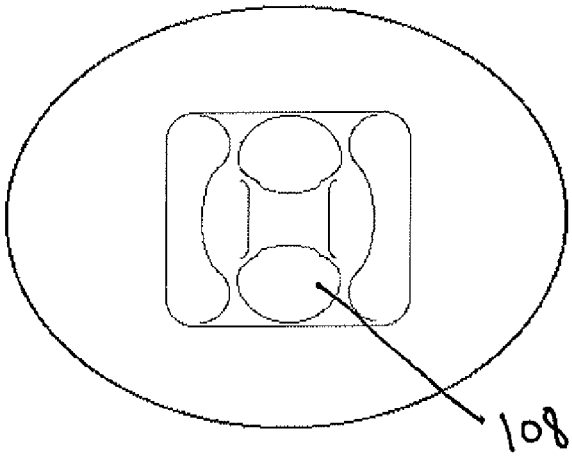
FIG. 17 is a top view of the apparatus in a oval form, showing the finger ling handle, according to an embodiment of the present invention.
Figure 18:
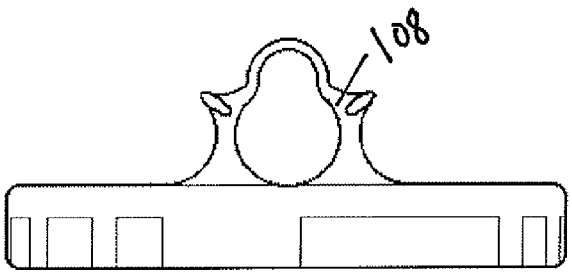
FIG. 18 is a side view of the apparatus of FIG. 17.
Figure 19:
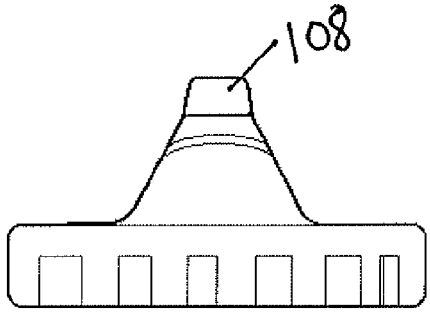
FIG. 19 is an end view of the apparatus of FIG. 17.
Figure 20:
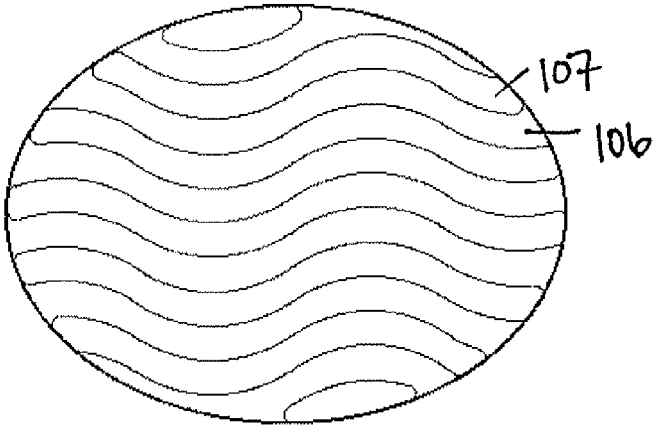
FIG. 20 is a bottom view of the apparatus in oval form of FIG. 17, showing the body massaging side.

FIG. 17 is a top view of the apparatus in a oval form, showing the finger ring handle 108, according to an embodiment of the present invention. FIG. 18 is a side view of the apparatus of FIG. 17 showing finger ring handle 108. FIG. 19 is an end view of the apparatus of FIG. 17. FIG. 20 is a bottom view of the apparatus in oval form of FIG. 17, showing the body massaging surface 106. The surface 106 has multiple ribs 107 for massaging. The ribs 107 can be of multiple heights and widths, as well as spaced at varying distances from one another, and in different spatial arrangements, in order to facilitate a range of massaging intensities. The body massaging surface 106 may reduce the look of cellulite when a user applies pressure to massage cellulite with the ribs 107. The massaging surface 106 can also be used outside of the bath by athletes to prevent muscle cramping by massaging the body after exercise.

Figure 21:
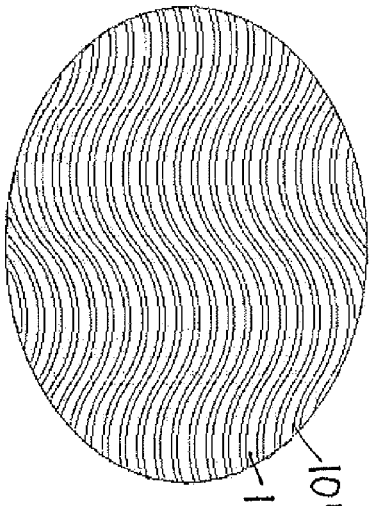
FIG. 21 is a bottom view of the apparatus in mini oval form, showing the pet fur scrubbing side.
Figure 22:
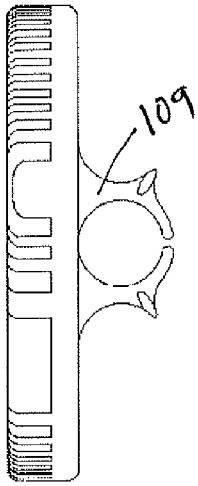
FIG. 22 is a side view of the apparatus of FIG. 21.
Figure 23:
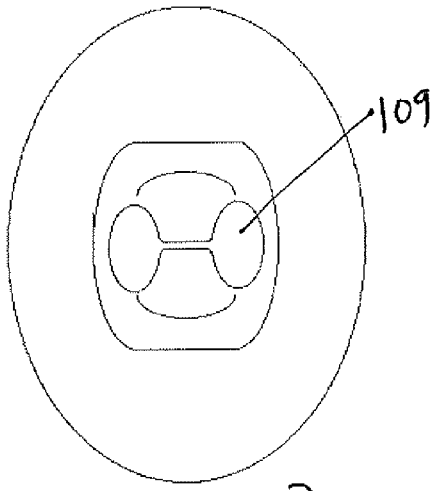
FIG. 23 is a top view of the apparatus of FIG. 21, showing the open finger ring handle, according to an embodiment of the present invention.
Figure 24:
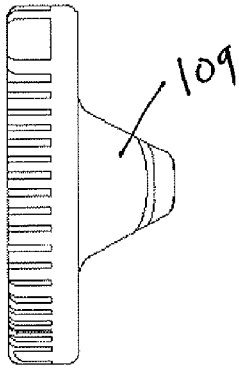
FIG. 24 is an end view of the apparatus of FIG. 21.

FIG. 21 is a bottom view of the apparatus in mini oval form, showing the pet body scrubbing surface 105. The surface 105 has body scrubber ribs 104 closely stacked together. This helps to hold the liquid soap during the scrubbing of the body and to create a rich lather. The ribs 104 can be of multiple heights and widths, as well as spaced at varying distances from one another, and in different spatial arrangements, in order to facilitate a range of scrubbing intensities. FIG. 22 is a side view of the apparatus of FIG. 21 showing the open finger ring handle 109. FIG. 23 is a top view of the apparatus of FIG. 21, showing the open finger ring handle 109, according to an embodiment of the present invention. The open finger ring handle 109 can accommodate various finger sizes. This handle 109 makes it easy for a user to hold the apparatus 101 while scrubbing a small animal, for example a cat or small dog. FIG. 24 is an end view of the apparatus of FIG. 21.

Figure 25:
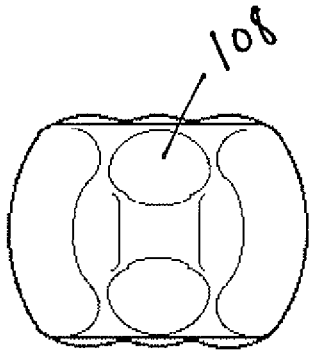
FIG. 25 is a top view of the apparatus in a mini facial bar form, showing the finger ring handle, according to an embodiment of the present invention.
Figure 26:
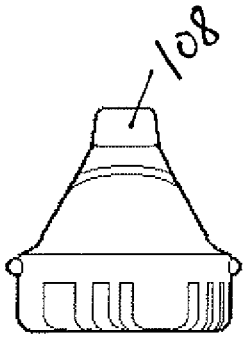
FIG. 26 is an end view of the apparatus of FIG. 25.
Figure 27:
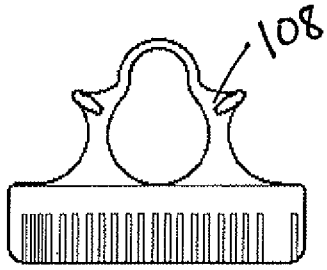
FIG. 27 is a side view of the apparatus of FIG. 25.
Figure 28:
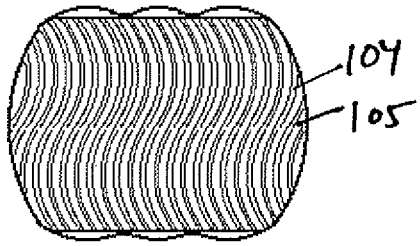
FIG. 28 is a bottom view of FIG. 25, showing the mini facial scrubbing side.

FIG. 25 is a top view of the apparatus 101 in a mini bar form, showing the finger ring handle 108, according to an embodiment of the present invention. FIG. 26 is an end view of the apparatus of FIG. 25. FIG. 27 is a side view of the apparatus of FIG. 25 showing the finger ring handle 108. FIG. 28 is a bottom view of FIG. 25, showing the mini scrubbing side 105. The surface 105 has mini scrubber ribs 104 closely stacked together. This helps to hold the liquid soap during the scrubbing of the body and to create a rich lather. The ribs 104 can be of multiple heights and widths, as well as spaced at varying distances from one another, and in different spatial arrangements, in order to facilitate a range of scrubbing intensities. The mini bar form is ideal for use on around the face.

Figure 29:
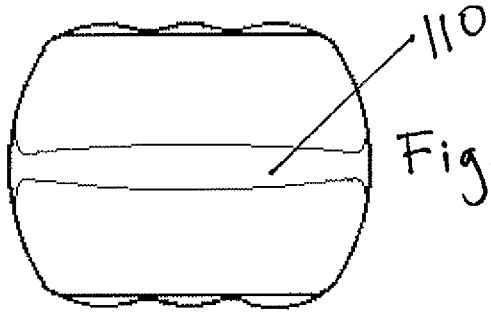
FIG. 29 is a top view of the apparatus in a mini bar form, showing the mushroom handle, according to an embodiment of the present invention.
Figure 30:
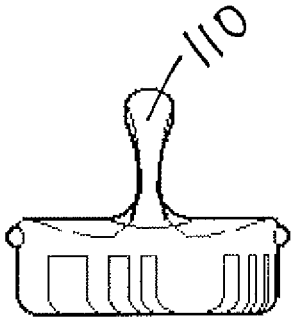
FIG. 30 is an end view of the apparatus of FIG. 29.
Figure 31:
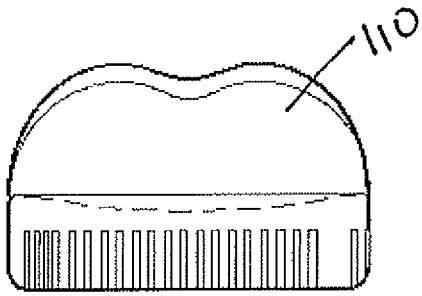
FIG. 31 is a side view of the apparatus of FIG. 29.
Figure 32:
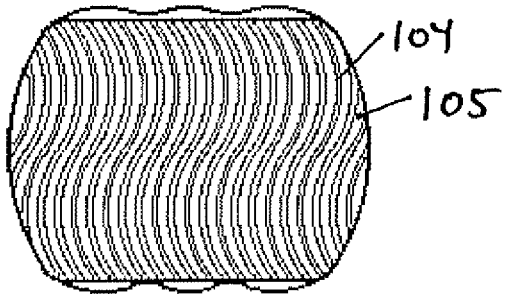
FIG. 32 is a bottom view of FIG. 29, showing the scrubbing side.

FIG. 29 is a top view of the apparatus in a mini bar form, showing the mushroom handle 110, according to an embodiment of the present invention. FIG. 30 is an end view of the apparatus of FIG. 29. FIG. 31 is a side view of the apparatus of FIG. 29 showing the mushroom handle 110. FIG. 32 is a bottom view of FIG. 29, showing the mini scrubbing side.

Figure 33:
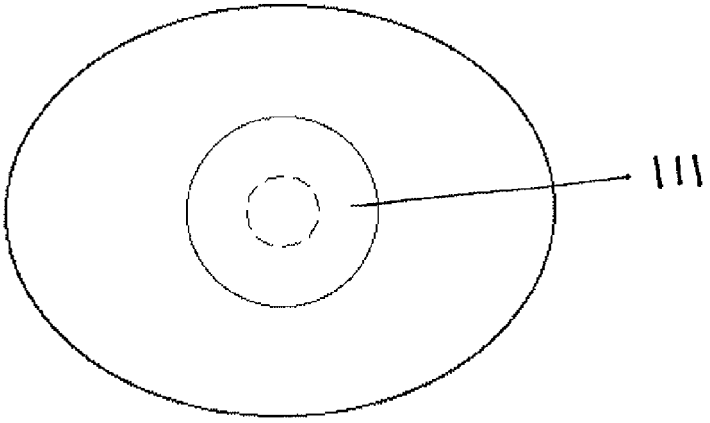
FIG. 33 is a top view of the apparatus in a oval form, showing an alternative mushroom handle, according to an embodiment of the present invention.
Figure 34:
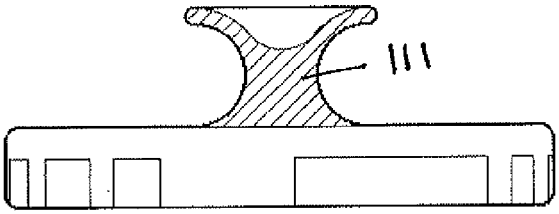
FIG. 34 is a side view of the apparatus of FIG. 33.
Figure 35:
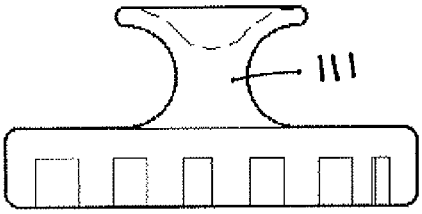
FIG. 35 is an end view of the apparatus of FIG. 33.
Figure 36:
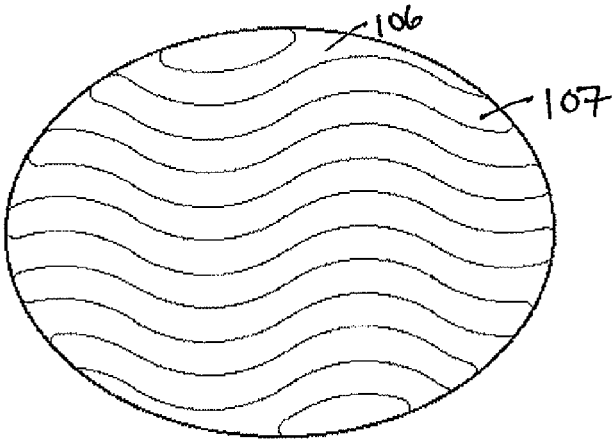
FIG. 36 is a bottom view of FIG. 33, showing the massaging side.

FIG. 33 is a top view of the apparatus in a oval form, showing an alternative mushroom handle 111, according to an embodiment of the present invention. FIG. 34 is a side view of the apparatus of FIG. 33. FIG. 35 is an end view of the apparatus of FIG. 33 showing the alternative mushroom handle 111. FIG. 36 is a bottom view of FIG. 33, showing the massaging surface 106. The surface 106 has multiple ribs 107 for massaging. The ribs 107 can be of multiple heights and widths, as well as spaced at varying distances from one another, and in different spatial arrangements, in order to facilitate a range of massaging intensities. The body massaging surface 106 may reduce the look of cellulite when a user applies pressure to massage cellulite with the ribs 107. The massaging surface 106 can also be used outside of the bath by athletes to prevent muscle cramping by massaging the body after exercise.

The apparatus 101 may be extruded with the varying surfaces 102,105, 106 or otherwise molded into the various shapes. In a preferred embodiment the entire apparatus 101 is molded in a single operation, using an appropriate rubber-like material, which in most cases will be a polymer material. The preferred durometer of the material is 58-60, however depending on the desired stiffness this can be higher or lower. The apparatus 101 may also be molded from antibacterial material. In some cases the varying surfaces 102, 105, 106, as well as, the ribs 104 and protuberances 103, may be made of a firmer material, and in some cases a stiffener may be molded into the surface regions 102, 105, and 106 for extra support. The material that the body bar 101 is made from may be clear, opaque, or in any of a variety of colors, and color may vary from region to region. The size of the apparatus can be of various sizes, depending on the surface area to be scrubbed or massaged. Smaller sizes are ideal for small surfaces such as a face or small pet, while larger sizes are ideal for human bodies and larger pets. Further the handles can be of various sizes to accommodate a finger, the palm of one's hand, or a handle that is gripped by the user.

It will be apparent to the skilled artisan that a number of alterations might be made to the embodiments of the present invention described thus far without departing from the spirit and scope of the invention. For example, there are a variety of materials that might be used in different embodiments. Natural or synthetic rubber might be used, and many rigid and semi-rigid materials might be used for the bar.

There are a variety of changes in dimensions that might be made within the spirit and scope of the invention. The inventions illustratively disclosed herein may be practiced without any element which is not specifically disclosed herein. For these and other reasons the invention is only limited by the scope of the claims that follow.

INDUSTRIAL APPLICABILITY

The present invention applies industrially to both the human and pet, bath and body industry. More particularly, the present invention applies industrially to body washing and therapeutic massage for humans and animals.

What is claimed is:

1. A hand-held cleaning apparatus to both cleanse and massage outer skin of a body comprising:

a flexible center panel having a first face including a first area covering the first face, a second face including a second area covering the second face, the second face opposite and parallel to the first face, a height between the first face and the second face, and a length in excess of a width;

a plurality of conical scrubbing protuberances filling the first area of said first face; and a plurality of evenly-spaced, parallel curved ribs of a uniform height of at least the height between the first face and the second face, said parallel ribs forming grooves capable of holding liquid cleanser, individual ones of the ribs extending fully across the width and filling the second area of the second face.

2. The cleaning apparatus of claim 1 where said apparatus is a single piece of molded polymer.

3. The cleaning apparatus claim 1 where the curved ribs are substantially sinusoidal in shape.

4. The cleaning apparatus of claim 1 where the apparatus is molded from antibacterial material.

* * * * *